US005422162A

United States Patent [19]

Passarino et al.

[11] Patent Number: 5,422,162

[45] Date of Patent: Jun. 6, 1995

[54] PAVEMENT MARKING TAPE WITH SUPPORT BASE COMPRISING A HIGHLY SATURATED ACRYLONITRILE ELASTOMER GRAFTED WITH A ZINC SALT OF METHYACRYLIC ACID

[75] Inventors: Sergio Passarino; Luigi Cazzaniga, both of Milan, Italy

[73] Assignee: Minnesota Mining and Manufacturing Company, St. Paul, Minn.

[21] Appl. No.: 328,616

[22] Filed: Oct. 25, 1994

Related U.S. Application Data

[63] Continuation of Ser. No. 977,909, Nov. 18, 1992, abandoned.

[30] Foreign Application Priority Data

Nov. 29, 1991 [IT] Italy ..... MI91A3213

[51] Int. Cl.[6] ..... E01F 9/08

[52] U.S. Cl. ..... 428/143; 428/424.7; 428/522; 428/215; 428/213; 428/220; 428/338; 428/149; 428/141; 428/323; 428/325; 359/538; 359/539; 359/540; 359/536; 359/537; 404/12; 404/14

[58] Field of Search ..... 428/424.7, 522, 215, 428/213, 220, 338, 149, 143, 141, 323, 325; 359/538, 539, 540, 536, 537; 404/12, 14

[56] References Cited

U.S. PATENT DOCUMENTS

| | | | |
|---|---|---|---|
| Re. 31,669 | 9/1984 | Eigenmann | 428/283 |
| 3,399,607 | 9/1968 | Eigenmann | 94/1.5 |
| 3,782,843 | 1/1974 | Eigenmann | 404/9 |
| 3,935,365 | 1/1976 | Eigenmann | 428/323 |
| 4,020,211 | 4/1977 | Eigenmann | 428/323 |
| 4,117,192 | 9/1978 | Jorgensen | 428/337 |
| 4,146,635 | 3/1979 | Eigenmann | 428/283 |
| 4,248,932 | 2/1981 | Tung et al. | 428/325 |
| 4,250,292 | 2/1981 | Niederdellmann et al. | 528/44 |
| 4,503,190 | 3/1985 | Fiore et al. | 525/108 |
| 4,530,859 | 7/1985 | Grunzinger | 528/45 |
| 4,757,110 | 7/1988 | Sato | 525/78 |
| 4,808,471 | 2/1989 | Grunzinger | 428/325 |
| 4,876,141 | 10/1989 | Kobayashi et al. | 428/217 |
| 4,983,678 | 1/1991 | Saito et al. | 525/193 |
| 4,990,024 | 2/1991 | Eigenmann | 404/12 |
| 5,077,117 | 12/1991 | Harper et al. | 428/143 |
| 5,127,973 | 7/1992 | Sengupta et al. | 156/60 |

FOREIGN PATENT DOCUMENTS 0162229 11/1985 European Pat. Off. .

OTHER PUBLICATIONS

Derwent Publications Ltd., London, GB; AN 89-371836 & DE A 3 918 929 (Nippon Zeon KK) 14 Dec. 1989.

*Primary Examiner*—William P. Watkins, III

*Attorney, Agent, or Firm*—Gary L. Griswold; Walter N. Kirn; Robert H. Jordan

[57] ABSTRACT

A conformable marking tape having improved mechanical properties comprises a support base and a top-coat layer, the support base comprising a highly saturated acrylonitrile elastomer grafted with a zinc salt of methacrylic acid. The top-coat layer preferably comprises a polyurethane resin having about 50 to about 65% by weight of rigid segments and about 35 to about 50% by weight of flexible segments. The rigid segments are derived from diisocyanates and aliphatic and/or cycloaliphatic chain extenders, and the flexible segments are derived from polymeric compounds having at least two active hydrogen atoms and having weight average molecular weights ranging from about 400 to about 4000.

23 Claims, 1 Drawing Sheet

PAVEMENT MARKING TAPE WITH SUPPORT BASE COMPRISING A HIGHLY SATURATED ACRYLONITRILE ELASTOMER GRAFTED WITH A ZINC SALT OF METHYACRYLIC ACID

This is a continuation of application Ser. No. 07/977,909, filed Nov. 18, 1992, now abandoned.

FIELD OF THE INVENTION

This invention relates to road surface marking tapes for use on roadway pavements to provide a traffic regulating line and/or other traffic information data thereon. More particularly, this invention relates to a new and improved tape having improved mechanical characteristics and being particularly suitable for heavy traffic conditions.

BACKGROUND OF THE ART

The art of marking road surfaces is widely known. Pavement markings, most commonly traffic lines, can be painted on the road surface, or formed thereon by applying molten material thereto, or provided thereon by applying and adhesively securing manufactured marking tapes.

The formed or applied traffic lines or other markings thereafter form a part of the road surface and are correspondingly subjected to the wear and destructive action of traffic.

A continuing goal in the pavement marking industry is to find economical products from which to form traffic control stripes having a longer useful life than the commonly used painted stripes. The inability to achieve this goal is in part signified by the variety of products presently used to form stripes on a roadway.

One class of products comprises epoxy resin-based paints. These products have a longer life than some other paints, but nevertheless have achieved only a small usage, probably because the epoxy resin cures slowly, necessitating elaborate and expensive application procedures. Also, the applied lines tend to spall and crack, show little impact resistance, and discolor with age.

Thicker coatings, such as thermoplastic polymers extruded or sprayed while in a molten condition, have produced some increase in life because of the greater amount of material to be worn away. However, the increased amount of material also increases the cost of the markings, and both expensive equipment and uncomfortable procedures are required to apply them. Also, the high profile of these markings can be disturbing to passing traffic, and the lines are especially susceptible to removal by snowplow blades. The markings will also spall, especially when applied to concrete, apparently because of the mismatch of thermal expansion characteristics between the rigid, thick markings and the concrete.

Road markings consisting of preformed tape or strip materials are well known in the art to be advantageous in comparison to the conventional traffic markings described above. The preformed marking tapes are typically formed from a composite structure comprising a support base of a calendered rubber compound, an adhesive bottom layer, and a top-coat anti-wear layer incorporating anti-skid material and light-retroreflective elements. Such a composite structure is disclosed in many patents, such as U.S. Pat. Nos. 3,782,843 (Eigenmann), 3,935,365 (Eigenmann), 3,399,607 (Eigenmann), 4,020,211 (Eigenmann), 4,117,192 (Jorgensen), and 4,990,024 (Eigenmann).

However, this composite structure still shows less than desired durability, especially under heavy traffic conditions and high working temperatures. Marking tapes comprising a support base of unvulcanized elastomer and a top-coat of polyurethane having a high capacity to be deformed, high permanent set, and low elastic return are disclosed in the art as suitable materials to obtain a superior durability. These materials deform readily into intimate contact with irregular pavement surfaces, absorb the energy of wheel impacts without fracture and avoid the stretch-return action that has been found to loosen marking tapes from a roadway pavement. A typical example of such a marking tape can be found in U.S. Pat. No. 4,117,192 (Jorgensen).

The support bases of prior art marking tapes typically comprise a Calendered tape of an unvulcanized rubber composition. Particularly useful materials are unvulcanized compositions comprising acrylonitrile-butadiene rubber (NBR) and having good conformability and physical properties. The conformability is typically further promoted by the inclusion of extender resins such as chlorinated paraffins, hydrocarbon resins or polystyrenes. The composition can also include mineral fillers and pigments. Support base thicknesses of 1 to 1.5 millimeters (mm) are necessary to achieve desired conformability and strength in prior art marking tapes. These marking tapes generally exhibit a tensile strength ranging from 15 to 35 kilograms/centimeter$^2$ (kg/cm$^2$) at room temperature but at temperatures higher than 30° C. typically have significantly less desirable mechanical characteristics. At the same time, vulcanized compositions cannot satisfy the need for good conformability.

Various modifications to the molecular compositions of polyurethane resins have been performed to improve conformability and elongation and to reduce elastic return. U.S. Pat. No. 4,248,932 (Tung et al.) discloses a marking tape comprising a conformable support layer and a flexible polyurethane top-coat layer. The European Patent Application having Publication No. 162,229 (Eigenmann) discloses a method to realize a conformable polyurethane top-coat by introducing into the polymer some particular molecular structures. In particular, a conformable polyurethane sheet is obtained by introducing into the polyurethane chain a deformable structure consisting of a) polyols having a functionality higher than two whose reactive hydroxyl groups are partially reacted with monofunctional compounds such as monoisocyanates, monohydroxyl derivatives and monocarboxylic acids to develop non-reactive pendant polymer branches and reduce the functionality of the polyols, and b) chain extenders, preferably aromatic materials which are sterically hindered like bisphenol-A-derivatives.

The partially reacted polyols and chain extenders improve conformability and reduce elastic return, but partially reacted polyols have a detrimental effect on abrasion resistance and on mechanical properties of the final product. In particular, the top-coat layer shows very good conformability, high elongation, and high flexibility, but also shows low mechanical properties, such as a low 10% modulus, low tensile strength and low toughness The term "10% modulus" as used herein, means the force per unit area (expressed in kg/cm$^2$) applied to the marking tape to produce a 10% elongation relative to its initial length. These factors reduce the modulus of the marking tape, making it too soft, particularly at temperatures higher than 30° C. Moreover, the use of bisphenol A or other aromatic chain extenders significantly reduces the UV light resistance of the marking tape.

These negative aspects are particularly relevant in the summer (during which pavement temperatures can increase to over 50° C.) and in heavy traffic conditions, e.g., at street intersections where vehicles are accelerating, braking and turning, and applying a very powerful thrust to the tape. This frequently causes damage to the marking tape, which locally flakes off, wrinkles up, and is sometimes torn apart. Moreover, these thrusts tend to displace the tape in the direction of the force, i.e., cause the tape to slide on the road pavement, thus detaching the tape from the pavement. Another negative aspect of this conformable marking tape is that it is prone to picking up dirt (i.e., dust, sand, pebbles or gravel, and the like) at temperatures over 30° C. In practice, this marking tape exhibits a very high Conformability to pavement but has too short of a life span.

U.S. Pat. No. Re. 31,669 (Eigenmann), a reissue of U.S. Pat. No. 4,146,635, discloses the use of a non-woven material interposed between a support base and a polyurethane top-coat to obtain a stiffer, less deformable and less temperature-sensitive marking tape. However, such a construction tends to have a high elastic return and a low adhesive strength, both of which promote detachment of the tape from the roadway.

Accordingly, in Spite of much work in the field of preformed marking tapes, there is still the need for an improved marking tape that exhibits a high permanent set with moderate elongation, high mechanical properties, less temperature sensitivity, and high durability under any Weather and traffic conditions.

SUMMARY OF THE INVENTION

This invention relates to an improved marking tape comprising a support base and a top-coat anti-wear layer which typically comprises anti-skid material and light-retroreflective elements, wherein the marking tape has the following properties in the temperature range of from about 0° C. to about 60° C.:

(a) a tensile strength of at least about 20 kg/cm$^2$, (b) an elongation at break lower than about 110%, (c) a permanent set higher than about 30%, and (d) a 10% modulus higher than about 30 kg/cm$^2$.

In particular, the present invention relates to an improved marking tape comprising a support base and a top-coat anti-wear layer, characterized in that the support base comprises a highly saturated acrylonitrile elastomer grafted with a zinc salt of methacrylic acid. In a preferred embodiment, the top-coat layer comprises a polyurethane resin comprising about 50 to about 65% by weight of rigid segments and about 35 to about 50% by weight of flexible segments. The rigid segments are derived from diisocyanates and aliphatic and/or cycloaliphatic chain extenders and typically have weight average molecular weights below about 400. The flexible segments are derived from polymeric compounds having at least two active hydrogen atoms and weight average molecular weights between about 400 and about 4000.

BRIEF DESCRIPTION OF THE DRAWING

The invention will be further explained with reference to the drawing, wherein.

Figure 1:
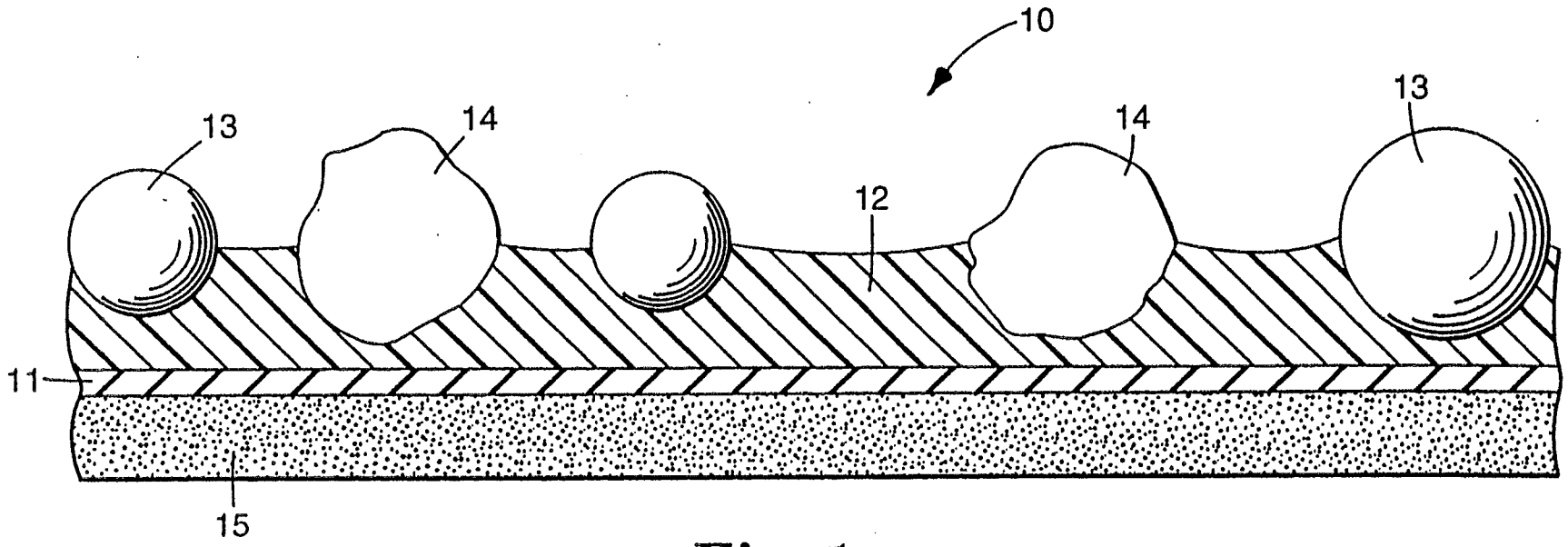
FIG. 1 shows in cross section a preformed marking tape of the invention.

This FIGURE, which is idealized, is not to scale and is intended to be merely illustrative and non-limiting.

DETAILED DESCRIPTION OF ILLUSTRATIVE EMBODIMENTS

An example of a preformed road marking tape of the present invention is illustrated as a marking tape 10 in FIG. 1. The marking tape 10 comprises a support base 11, a top-coat layer 12 adhered to one surface of the support base 11, and particulate material at least partially embedded in the top-coat layer 12 and typically partially exposed above the surface of the marking tape. In the illustrated embodiment, the particulate material comprises transparent microspheres 13, which serve as light-retroreflective elements, as well as irregularly shaped skid-resistant or anti-skid particles 14. Since adhesives are generally used to adhere marking tapes to roadways or other substrates, the marking tape 10 can include a layer 15 of pressure-sensitive adhesive or other adhesive.

The support base 11 comprises an unvulcanized elastomeric composition, the composition comprising a highly saturated acrylonitrile elastomer (HSN) which has been modified with a zinc salt of methacrylic acid. Highly saturated acrylonitrile elastomers are well known for their superior resistance to heat and oil, and for their high tensile strength, tear resistance, and abrasion resistance.

In the past, the physical properties of HSN have been enhanced by using conventional reinforcing agents such as silica. According to the present invention, the desirable physical properties of the HSN elastomer are enhanced by grafting a zinc salt of methacrylic acid onto the HSN elastomer. Preferably, the elastomeric composition comprises ZSC TM 2295, a highly saturated acrylonitrile elastomer grafted with a zinc salt of methacrylic acid, available from Nippon Zeon Co. LTD.

The reinforcement of HSN with a zinc salt of methacrylic acid is believed to occur as a result of the formation of molecules of a zinc salt of methacrylic acid from zinc oxide (ZnO) and methacrylic acid and the grafting of these molecules onto the HSN elastomer chain. It is believed that zinc oxide and methacrylic acid are mixed in a weight percent ratio of about 3:4 in the ZSC TM 2295 elastomeric composition. Further, it is believed that from 35 to 70 parts by weight of the zinc salt of methacrylic acid molecules and 100 parts by weight of the HSN elastomer are mixed in forming the ZSC TM 2295 elastomeric composition.

The degree of reinforcement is believed to depend on three factors: the affinity of the HSN elastomer to the zinc methacrylic acid salt, the degree of radical reactivity, and the microcrystalline character of the elastomer.

Typically, the elastomeric composition includes an appropriate amount of additives including particulate fillers and extender resins such as chlorinated paraffins, hydrocarbon resins, or polystyrenes. The elastomer precursors, including the zinc-methacrylic acid modified HSN elastomer, preferably account for at least about 50 weight percent of the polymeric ingredients in the elastomeric composition. Moreover, a blend of zinc-methacrylic acid modified HSN elastomer and standard acrylonitrile-butadiene rubber (NBR), HSN elastomer, or ethylene/vinyl acetate (EVA) copolymer in a weight percent ratio of from about 90:10 to about 50:50 also exhibits the desired physical properties and conformability in calendered tapes of very low thickness (ranging from about 0.3 to about 0.7 mm).

In the range of from about 0° C. to about 70° C., support bases of the invention have a very high tensile strength (at least about 20 kg/cm$^2$, preferably at least about 50 kg/cm$^2$), a good elongation at break (from about 30% to about 110%), a very high 10% modulus (more than about 30 kg/cm$^2$), a very high conformability (permanent set higher than about 30%), and a reduced temperature sensitivity.

Throughout this application unless otherwise noted, the values for 10% modulus, permanent set, tensile strength, elongation at break and at the yield point, and stress at the yield point were determined by carrying out a test procedure at about 20° C. using an Instron Universal Testing Instrument wherein a 10.2 cm long test sample was extended at about 2.5 cm per minute to give a strain rate of about $4.2\times10^{-3}$/sec.

Notwithstanding that the support base 11 is preferably made as thin as possible, the limits necessary for providing the required bond to the roadway pavement, consistency, and if desired, resistance and inextensibility, require that the support base 11 be thicker than the top-coat layer 12. Typically, the support base is about 0.5 to about 0.9 mm thick, and most preferably about 0.5 mm thick. Since the top-coat layer 12 is the portion of the construction which is progressively worn by the traffic, it is preferably wear-resistant. Further, the top-coat layer 12 preferably has desirable anti-skid and nighttime visibility properties.

Typically, the top-coat layers of pavement markings comprise one or more polymeric binders possessing a high internal molecular cohesion. Examples of such polymeric binders are polyamide resins, polyvinyl derivatives, flexible epoxy resins, ethylene copolymers, polyester resins such as polyethylene terephthalates, and polyurethane resins.

Polyurethane resins have been used for many years because of their high tensile and tear strength and excellent abrasion resistance. The term polyurethane resin is not limited to polymers that only contain urethane groups, but as well understood in the art, refers to polymers which contain urethane groups, regardless of what the rest of the molecule may be. Typically, polyurethane compounds are obtained by reacting polyisocyanates with organic compounds having at least two active hydrogen atoms, usually polyhydroxy compounds, such as polyethers, polyesters, castor oils, or glycols. Compounds containing amine and carboxyl groups may also be used. Thus, a typical polyurethane compound may contain, in addition to urethane groups, aliphatic and aromatic hydrocarbon residues, ester groups, ether groups, amide groups, urea groups, and the like.

The urethane group has the following characteristic structure:

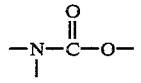

and polyurethane compounds have a significant number of these groups, although not necessarily repeating in a regular order.

The most common method of forming polyurethane compounds is by reacting di- or polyfunctional hydroxy compounds, such as hydroxyl-terminated polyesters or polyethers, with di- or polyfunctional isocyanates. Examples of useful diisocyanates are represented by the following formula:

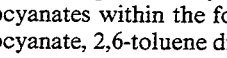

wherein R can be represented by substituted or unsubstituted alkylene, cycloalkylene, arylene, alkylenebisarylene, arylenebisalkylene, or an oligomer obtained by reacting 2 molecules of a diisocyanate with one molecule of an aliphatic or cycloaliphatic diol. Examples of diisocyanates within the formula above are 2,4-toluene diisocyanate, 2,6-toluene diisocyanate, 4,4'-diphenylmethane diisocyanate, dianisidine diisocyanate, toluidine diisocyanate, naphthylene diisocyanate, hexamethylene diisocyanate, m-xylidine diisocyanate, pyrene diisocyanate, isophorone diisocyanate, ethylene diisocyanate, propylene diisocyanate, octadecylene diisocyanate, methylenebis(4-cyclohexyl isocyanate), 1,4-cyclohexane diisocyanate and the like.

Examples of di- or polyfunctional hydroxy compounds are polyethers and polyesters having a weight average molecular weight of from about 200 to about 20,000, preferably of from about 300 to about 10,000. Most of the polyethers used for the manufacture of polyurethanes are derived from polyols and/or poly(oxyalkylene) derivatives thereof. Examples of useful polyols include: 1) diols such as alkylene diols of 2 to 10 carbon atoms, arylene diols such as hydroquinones, and polyether diols [$HO(RO)_nH$] where R is an alkylene; 2) triols such as glycerol, trimethylol propane, and 1,2,6-hexanetriol; 3) tetraols such as pentaerythritol; and 4) higher polyols such as sorbitol, mannitol, and the like. Examples of polyesters used for the manufacture of polyurethanes are saturated polyesters having terminal hydroxy groups, low acid number and water content, derived from adipic acid, malonic acid, succinic acid, glutaric acid, pimelic acid, maleic acid, fumaric acid, phthalic acid, isophthalic acid, ethylene glycol, propylene glycol, 1,3-butylene glycol, 1,4-butylene glycol, diethylene glycol, 1,6-hexanediol, 1,2,6-hexanetriol, trimethylolpropane, trimethylolethane, neopentylglycol and the like. Other desirable polyols include castor oil (a mixture of esters of glycerol and fatty acids such as ricinoleic acid), lactones having end hydroxyl groups such as polycaprolactone, and block copolymers of propylene and/or ethylene oxide copolymerizered with ethylene diamine.

Although support bases of the invention can be used with conventional top-coat layers, it has further been discovered that a polyurethane top-coat does not need high flexibility and high elongation to be conformable. On the Contrary, it has been observed that a polyurethane top-coat can be tough, high in modulus and low in elongation if it possesses high permanent set (preferably more than about 30%, most preferably more than about 50%) after strain and good resistance to bending at low temperatures. The advantages provided by a polyurethane top-coat having this combination of physical properties have apparently never been appreciated by others working in the pavement marking tape field.

To provide a polyurethane top-coat having such a combination of physical properties, it has been found that the polyurethane composition must contain a large portion of rigid blocks, deriving from diisocyanates and aliphatic and/or cycloaliphatic chain extenders and typically having weight average molecular weights below about 400, and a minor portion of flexible blocks, these latter being characterized by different functionality and molecular size. These blocks are alternatively referred to in the polymer art as hard segments and soft segments, respectively.

The chemical structure of the polyurethane top-coat layer of the present invention is represented by a composition comprising about 50 to about 65 weight percent of rigid segments and about 35 to about 50 weight percent of flexible segments.

The rigid segments of the chemical structure are derived from diisocyanates, e.g., isophorone diisocyanate, and aliphatic and/or cycloaliphatic chain extenders comprising preferably 1,4-butanediol, 1,6-hexanediol, neopentylglycol, ESTERDIOL TM (a neopentylglycol-derivative available from Union Carbide), trimethylolpropane, hydroxylamines, polyamines, cyclohexanedimethanol, and hydrogenated bisphenol and its ethoxy- and propoxy-derivatives possessing primary and secondary hydroxy groups. Hydrogenated bisphenol is obtained by hydrogenating the two benzene rings of bisphenol to thereby obtain a compound comprising two cyclohexane rings. Hydrogenated bisphenol has a higher resistance to ultraviolet radiation than bisphenol, an aromatic compound. Hydroxyalkyl derivatives of hydrogenated bisphenol can be obtained by reacting the hydroxy group(s) of hydrogenated bisphenol with an ethylene or propylene oxide.

The flexible segments of the chemical structure are derived from polymeric compounds having at least two active hydrogen atoms such as linear and branched polyhydroxy derivatives, e.g., a polyol mixture based on polyols such as polyester polyols and polyether polyols, the polymeric compounds having weight average molecular weights between about 400 and about 4000, preferably between about 600 and about 2000.

A polyurethane top-coat layer comprising the above composition has the following properties in the temperature range of from about 0° C. to about 60° C.:

a) High permanent set at the break point, i.e., the ratio of (1) the elongation of the top-coat layer at the break point measured 5 minutes after release of the load, to (2) the elongation of the top-coat layer at the break point, expressed as a percent. The permanent set at the break point for the top-coats of the present invention is preferably higher than about 30%, most preferably in the range of from about 35% to about 65%.

b) Elongation at break is in the range of from about 10% to about 110%, preferably of from about 50% to about 100%.

c) Stress at the yield point of at least about 150 $kg/cm^2$, preferably of from about 150 to about 300 $kg/cm^2$.

d) Elongation at the yield point of from about 5% to about 15%.

e) Tensile strength of at least about 200 $kg/cm^2$.

A polyurethane top-coat layer comprising the above composition also has good resistance to cracking at low temperatures expressed as resistance to break after 3 bendings at a 180° angle, each set of three bendings performed both at −5° C. and at 0° C. The bending test comprises the following steps: (1) preparing two 10.2 cm long samples of substantially identical top coat composition by preparing the composition, casting the composition onto a release paper liner to form a polyurethane layer of about 0.10 mm thickness, and curing the polyurethane by placing the composite in an oven at 110° to 120° C. for about 4 minutes and then at 70° C. for about 7 hours, and then removing the paper liner, (2) performing a first set of three bendings at 0° C. on the first sample, and (3) performing a second set of three bendings at −5° C. on the second sample. Each bending test is carried out by manually bending one end of the sample within a few seconds so that it contacts the opposing end of the sample. A good performance is manifested by the absence of either breaks or cracks on both the first and second samples.

Top-coat layers according to the present invention exhibit a clearly marked yield point, i.e., the top-coats require a relatively high initial load to be deformed after which there is plastic flow (with no elastic behavior) without a significant increase of load level for further deformation. A high yield point makes the polyurethane top-coat suitable for resisting the tremendous stresses induced by traffic, in particular at intersections, as well as high conformability, without cracks or breaks, due to the plastic flow of the polyurethane composition.

The improvement in toughness and conformability of the polyurethane top-coat not only makes the top-coat highly resistant to dirt pick-up and to mechanical stresses but also permits the use of a thinner and harder support base. The use of a thinner support base results in a less expensive marking tape and less protrusion of the marking tape from the road surface so that traffic is much less likely to shear and remove the tape from the road surface. Moreover, the top-coat itself can be thinner than those of the prior art. Preferably, the top-coat layer 12 is less thick than the average diameter of the microspheres that are embedded in it. Preferably, the top-coat layer has a thickness of from about 0.025 to about 0.25 mm, more preferably of from about 0.05 to about 0.15 mm.

The road marking tapes of the present invention have the following properties in the temperature range of from about 0° C. to about 60° C.:

(a) a tensile strength of at least about 20 $kg/cm^2$, (b) an elongation at break lower than about 110%, (c) a permanent set higher than about 30%, and (d) a 10% modulus higher than about 30 $kg/cm^2$.

Although the road marking tapes of the present invention can be formed by coating a liquid mixture of the top-coat layer ingredients directly on the support base, the top-coat layer may alternatively be formed separately and then bonded to the support base in a laminating operation, as by interposing an adhesive layer between the top-coat layer and the support base.

The light-retroreflective elements, usually microspheres or other durable, generally inorganic particulate material, are partially embedded in the top-coat layer, typically in a scattered or random manner. A scattered arrangement of glass microspheres provides the amount of retroreflectivity typically expected of pavement markings, and is more skid-resistant than a densely packed layer of microspheres. The microspheres and any other particulate additives are partially embedded in the top-coat layer during its formation, e.g., by cascading them onto the carrier web after a liquid mixture of the top-coat layer ingredients has been coated on the carrier web and partially solidified. In less preferred embodiments, the microspheres may be adhered to the top-coat layer with a coating of adhesive or binder material.

The glass microspheres typically have an index of refraction of between about 1.5 and about 2.5, and preferably have a refractive index of at least about 1.7 to provide good retroreflectivity under dry conditions. If the tape is predominantly used in wet conditions, some or all of the microspheres should have a refractive index of about 2.2 or higher. The size of the microspheres is usually in the range of from about 150 μm to about 800 μm in diameter, and other particulate materials will generally have a similar order of size.

Irregular or angular, inorganic skid-resisting particles such as sand, quartz, corundum, beryllium, silicon carbide or other abrasive particles are preferably included in marking tapes of the invention together with the microspheres and, for any particular uses where no retroreflectivity is needed, skid-resisting particles may be the only particles provided. Preferably, the anti-skid particles exhibit a hardness of at least about 6° on the Mohs' Hardness Scale, more preferably at least about 7°. The number of skid-resisting elements in a given volume of top-coat layer is determined, by simple experimentation, so that not more than about 20% of the surface area is covered thereby, preferably not more than about 10%. The density of such elements is a function of the physical characteristics of such elements (their hardness and sharpness is related to their ability to provide more or less grip on the vehicle tires) and of the average traffic on the roadway to be marked. The average dimension of each particle is preferably in the range of from about 0.1 to about 1 mm, more preferably from about 0.5 to about 0.8 mm, and most preferably about 0.7 mm. A British Pendulum Stanley London skid resistance testing instrument is preferably used in measuring the skid resistance of marking tapes of the invention.

The microspheres or other totally or partially embedded particles are preferably treated with a binder that improves adhesion between them and the top-coat layer. Such a binder may be added in the top-coat layer, where it contacts the microspheres or other particles when they are embedded in the layer. The molecules of such a binder generally have an inorganic portion which associates with the microspheres or the particles, and an organic portion, which associates with and may react with organic ingredients of the top-coat layer. Silane and titanate coupling agents are particularly useful. Preferably, the binder is selected from the group consisting of polyester resins, acrylic and methacrylic resins, polyvinyl butyrals, and most advantageously, epoxy resins. Inorganic binders can also be used such as, for example, silicate binders added to a chlorinated rubber latex.

Pigments or other coloring agents are typically included in the top-coat layer in an amount sufficient to color the tape for use as a pavement marking. Titanium dioxide is typically used to obtain a white color, whereas lead chromate is typically used to provide a yellow color. Red and orange are also standard traffic control colors, and other colors can be used for special purpose markings.

EXAMPLES

The invention will be further explained by the following illustrative examples which are intended to be nonlimiting. Unless otherwise indicated, all amounts are expressed in parts by weight. Further, unless otherwise indicated, all physical properties were measured in accordance with the description set forth hereinabove.

Example 1

Seven polyurethane top-coat layers were prepared with the following ingredients:

TABLE 1

| | 1 inv. | 2 inv. | 3 inv. | 4 inv. | 5 inv. | 6 inv. | 7 inv. |
|---|---|---|---|---|---|---|---|
| FLEXIBLE PORTION | | | | | | | |
| BD/TMP/ ADIPATE | 31.94 | 31.94 | 31.94 | 31.94 | 31.94 | 31.94 | 31.94 |
| BD/ADIPATE DIOL | 21.40 | 10.64 | 10.74 | 27.65 | 22.80 | 12.04 | 17.62 |
| HMD/ADIPATE | 0 | 3.70 | 4.0 | 1.0 | 0 | 6.0 | 5.0 |
| RIGID PORTION | | | | | | | |
| ISOPHORONE DIISOCYANATE | 55.66 | 56.25 | 58.61 | 57.00 | 70.80 | 64.25 | 54.00 |
| 1,4-BUTANEDIOL | 6.34 | 14.36 | 16.18 | 10.84 | 12.20 | 15.62 | 7.62 |
| NEOPENTYL-GLYCOL | 7.76 | 0 | 0 | 0 | 0 | 2.70 | 0 |
| ESTERDIOL TM 204 | 0 | 0 | 0 | 0 | 11.70 | 0 | 0 |
| CYCLOHEXANE DIMETHANOL | 0 | 0 | 0 | 0 | 0 | 0 | 9.0 |
| HYDROGEN-ATED BIS-PHENOL | 0 | 0 | 0 | 7.00 | 0 | 0 | 0 |
| TITANIUM DIOXIDE | 67 | 66 | 66 | 63 | 61.80 | 66 | 94 |

"BD" = 1,4-butane diol
"TMP" = trimethylolpropane
"HMD" = hexamethylenediol
ESTERDIOL TM is a trade name of a neopentylglycol-derivative produced by Union Carbide.

The respective ingredients of Table 1 were mixed and then cast onto a release paper liner to form a polyurethane layer of about 0.10 mm thickness. The composite was placed in an oven at about 110° to 120° C. for 4 minutes and then at about 70° C. for about 7 hours to cure the polyurethane. After removing the paper liners, the mechanical properties at room temperature of the polyurethane top-coat layers were determined and are summarized in Table 2.

TABLE 2

| PROPERTIES | 1 inv. | 2 inv. | 3 inv. | 4 inv. | 5 inv. | 6 inv. | 7 inv. |
|---|---|---|---|---|---|---|---|
| TENSILE STRENGTH Kg/cm$^2$ | 315 | 261 | 455 | 300 | 285 | 297 | 260 |
| ELONGATION AT BREAK % | 77% | 85% | 39% | 65% | 110% | 50% | 73% |
| PERMANENT SET % | 65% | 41% | 64% | 50% | 41% | 40% | 26% |
| LOAD AT THE YIELD POINT Kg/cm$^2$ | 315 | 233 | 455 | 280 | 281 | 297 | 213 |
| RESISTANCE TO 3 BENDINGS OF 360° AT −5° C. | YES | YES | YES | YES | YES | YES | YES |

The data of Table 2 clearly show the superior mechanical properties of the polyurethane top-coats of the present invention. In particular, the high values for tensile strength and load at the yield point make the polyurethane top-coats very resistant to wear and heavy traffic conditions. At the same time, the high values for permanent set make the top-coat layers very conformable to the roadway pavement, and suitable to be used with a support base that is thinner than prior art support bases.

Example 2

Four support bases comprising the compositions set forth in Table 3 were prepared. Composition 1 is a comparative example, and compositions 2, 3, and 4 are examples of the invention. Each sample was prepared by mixing the ingredients of Table 3 together in the amounts shown in a Banbury mixer, where the ingredients reached a temperature of approximately 100° C. The mixture was then cooled to about 70° to 80° C. and calendered into a sheet about 0.6 mm thick.

TABLE 3

| INGREDIENTS | 1 comp. | 2 inv. | 3 inv. | 4 inv. |
|---|---|---|---|---|
| ZSC TM 2295 | 0 | 100 | 70 | 50 |
| BREON TM 3325 | 50 | 0 | 0 | 0 |
| PERBUNAN TM 1807 | 50 | 0 | 30 | 50 |
| CHLOROPARAFFIN TM 70 | 80 | 80 | 80 | 80 |
| CHLOROPARAFFIN TM 68 | 15 | 15 | 15 | 15 |
| VULCASIL S TM VN3 | 35 | 35 | 35 | 35 |
| MISTRON SUPERFROST TM | 200 | 200 | 200 | 200 |
| TITANIUM DIOXIDE | 150 | 150 | 150 | 150 |
| ANOX T TM antioxidant | 3 | 3 | 3 | 3 |
| STEARIC ACID | 3 | 3 | 3 | 3 |

ZSC TM 2295 is the trade name of a highly saturated acrylonitrile elastomer grafted with a zinc salt of methacrylic acid produced by Nippon Zeon Co. Ltd., BREON TM 3325 is the trade name of an acrylonitrile-butadiene rubber produced by Nippon Zeon Co., PERBUNAN TM 1807 is the trade name of an acrylonitrile-butadiene synthetic rubber produced by Bayer & Co., CHLOROPARAFFIN TM 70 and 68 are the trade names of two chloroparaffins containing respectively 70 and 65 mole % of chlorine produced by Hoechst Caffaro S.p.A., VULCASIL S TM VN3 is the trade name of an amorphous silica produced by Bayer, MISTRON SUPERFROST TM is the trade name of a mixture of talc (95%) and chlorite (5%) produced by Cyprus Industrial Mineral, and ANOX T TM is the trade name of a phenol-modified antioxidant produced by Bozzetto S.p.A.

The mechanical properties of the elastomeric support bases obtained from the recipes of Table 3 are set forth in Table 4.

TABLE 4

| PROPERTIES | 1 comp. | 2 inv. | 3 inv. | 4 inv. |
|---|---|---|---|---|
| At 20° C. | | | | |
| Tensile strength kg/cm$^2$ | 21 | 175 | 140 | 110 |
| Elongation % | 400 | 76 | 85 | 85 |
| Modulus (10%) kg/cm$^2$ | 11 | 84 | 66 | 45 |
| Permanent set % | 40 | 70 | 60 | 55 |
| At 50° C. | | | | |
| Tensile strength kg/cm$^2$ | 4 | 110 | 65 | 21 |
| Elongation % | 200 | 110 | 110 | 100 |
| At 70° C. | | | | |
| Tensile strength kg/cm$^2$ | — | 65 | 32 | — |
| Elongation % | — | 100 | 120 | — |
| Resistance to 3 bendings of 180° at | | | | |
| +5° C. | YES | YES | YES | YES |
| 0° C. | YES | NO | YES | YES |
| −5° C. | YES | NO | YES | YES |

"—" = a value too low to be measured

The data of Table 4 clearly illustrate the superior mechanical characteristics of the support bases of the present invention compared with the mechanical characteristics of a prior art support base. In considering the 20° C. values, the higher tensile strength, the higher 10% modulus, and the lower elongation make the support bases of the invention very resistant to heavy traffic conditions and allow for the support bases to be thinner. At the same time, the high permanent set value makes the support bases of the invention very conformable to the roadway pavement and less prone to elastic return. Further, the high permanent set and high 10% modulus values of the support bases of the invention contribute to the ability of the overall marking tapes to be less prone to dirt pickup. In considering the 50° and 70° C. values, the comparative example shows an 80% reduction of tensile strength upon increasing the temperature from 20° C. to 50° C. and a great loss of tensile strength and elongation at 70° C. On the contrary, the support bases comprising compositions 2 and 3 maintained good values for tensile strength and elongation both at 50° C. and 70° C. The support base comprising composition 4 suffered a loss of good mechanical characteristics at 70° C. due to the high percentage of PERBUNAN TM 1807 (the same concentration used in, the support base comprising comparative composition 1), but had useful mechanical properties at 20° C. and 50° C. with a tensile strength value at 50° C. equal to that of the comparative example at 20° C.

Example 3

A roadway marking tape was prepared by coating a polyurethane top-coat comprising composition 6 of Example 1 at a thickness of 0.09 mm on a support base comprising composition 3 of Example 2 and having a thickness of 0.65 mm. The tape was made by first preparing the support base as described in Example 2, mixing the ingredients of composition 6 of Example 1, casting this mixture of ingredients onto the support base, partially embedding anti-skid particles and light-retroreflective elements in the top-coat mixture by cascading these materials onto the top-coat layer, and then curing the top-coat by heating the composite at about 110° to 120° C. for about 4 minutes and then at about 70° C. for about 7 hours.

The mechanical properties at room temperature of the road marking tape are summarized in Table 5:

TABLE 5

| | |
|---|---|
| TENSILE STRENGTH Kg/cm$^2$ | 76 |
| ELONGATION AT BREAK % | 66% |
| PERMANENT SET % | 50% |

Various modifications and alterations of this invention will become apparent to those skilled in the art without departing from the scope and spirit of this invention.

What is claimed is:

1. A marking tape comprising a support base and a top-coat layer wherein said support base comprises an unvulcanized elastomeric composition, said elastomeric composition comprising a highly saturated acrylonitrile elastomer grafted with a zinc salt of methacrylic acid, and in the temperature range of from about 0° C. to about 60° C. said tape having a tensile strength of at least about 20 kilograms/centimeter$^2$, an elongation at break lower than about 110%, a permanent set higher than about 30%, and a 10 percent modulus higher than about 30 kilograms/centimeter$^2$.

2. The marking tape of claim 1 wherein said top-coat layer comprises a polyurethane resin comprising:

a) about 50 to about 65% by weight of rigid segments; and b) about 35 to about 50% by weight of flexible segments.

3. The marking tape of claim 2 wherein:

a) said rigid segments are derived from a diisocyanate and a chain extender selected from the group consisting of aliphatic and cycloaliphatic chain extenders; and b) said flexible segments are derived from polymeric compounds having at least two active hydrogen atoms and having weight average molecular weights ranging from about 400 to about 4000.

4. The marking tape of claim 1 wherein said support base comprises said highly saturated acrylonitrile elastomer grafted with a zinc salt of methacrylic acid and an acrylonitrile butadiene rubber mixture in a weight percent ratio of from about 90:10 to about 50:50.

5. The marking tape of claim 1, wherein said support base exhibits in the temperature range of from 0° to 50° C. a tensile strength of at least about 20 kg/cm$^2$, an elongation at break of from about 30% to about 110%, a permanent set higher than about 30%, and a 10% modulus higher than about 30 kg/cm$^2$.

6. The marking tape of claim 1 wherein said support base has a thickness of from about 0.3 to about 0.7 mm.

7. The marking tape of claim 3 wherein said diisocyanate is selected from the group consisting of 2,4-toluene diisocyanate, 2,6-toluene diisocyanate, 4,4'-diphenylmethane diisocyanate, dianisidine diisocyanate, toluidine diisocyanate, naphthylene diisocyanate, hexamethylene diisocyanate, m-xylidine diisocyanate, pyrene diisocyanate, isophorone diisocyanate, ethylene diisocyanate, propylene diisocyanate, octadecylene diisocyanate, methylenebis(4-cyclohexyl isocyanate), and 1,4-cyclohexane diisocyanate.

8. The marking tape of claim 3 wherein said chain extender is selected from the group consisting of 1,4-butanediol, 1,6-hexanediol, neopentylglycol, neopentylglycol-derivatives, trimethylolpropane, hydroxyl amines, polyamines, cyclohexanedimethanol, and hydrogenated bisphenolalkoxy derivatives.

9. The marking tape of claim 3 wherein said polymeric compounds comprise at least one of linear and branched polyhydroxy derivatives.

10. The marking tape of claim 9 wherein said polyhydroxy derivatives are selected from the group consisting of polyester polyols and polyether polyols, and have weight average molecular weights of between about 600 and about 2000.

11. The marking tape of claim 3 wherein said top-coat layer exhibits in the temperature range of from 0° C. to 60° C. a tensile strength of at least about 200 kg/cm$^2$, an elongation at break of from about 10% to about 110%, and a permanent set higher than about 30%.

12. The marking tape of claim 3 wherein said top-coat layer has a thickness of from about 0.025 to about 0.25 mm.

13. The marking tape of claim 3 wherein a monolayer of particles is at least partially embedded in said top-coat layer.

14. The marking tape of claim 13 at least some of said particles are light-retroreflective particles.

15. The marking tape of claim 14 wherein said light-retroreflective particles comprise glass microspheres.

16. The marking tape of claim 15 wherein said glass microspheres have a diameter of from about 150 μm to about 800 μm.

17. The marking tape of claim 15 wherein said glass microspheres have a refractive index of from about 1.5 to about 2.5.

18. The marking tape of claim 13 wherein said particles comprise anti-skid particles,

19. The marking tape of claim 18 wherein said anti-skid particles have a size of from about 0.1 to about 1 mm.

20. The marking tape of claim 18 wherein said anti-skid particles have a hardness of at least about 6° on the Mohs' Hardness Scale,

21. The marking tape of claim 1 further comprising an adhesive layer disposed between said top-coat layer and said support base for bonding said top-coat layer and said support base together.

22. The marking tape of claim 1 (characterized in that) wherein said elastomeric composition comprises elastomer precursors which account for at least about 50 weight percent of the polymeric content of said support base.

23. A marking tape comprising a support base and a top-coat layer wherein said support base comprises an unvulcanized elastomeric composition, said elastomeric composition comprising a highly saturated acrylonitrile elastomer grafted with a zinc salt of methacrylic acid, wherein said support base exhibits in the temperature range of from 0° to 50° C. a tensile strength of at least about 20 kilograms/centimeter$^2$, an elongation at break of from about 30 percent to about 110 percent, a permanent set higher than about 30 percent, and a 10 percent modulus higher than about 30 kilograms/centimeter$^2$, and said top-coat layer exhibits in the temperature range of from 0° C. to 60° C. a tensile strength of at least about 200 kilograms/centimeter$^2$, an elongation at break of from about 10 percent to about 110 percent, and a permanent set higher than about 30 percent.

* * * * *

UNITED STATES PATENT AND TRADEMARK OFFICE

CERTIFICATE OF CORRECTION

PATENT NO.: 5,422,162

DATED: June 6, 1995

INVENTOR(S): Sergio Passarino et al.

It is certified that error appears in the above-identified patent and that said Letters Patent is hereby corrected as shown below:

In Column 2, Line 18, the word "Calendered" should not be capitalized.

In Column 3, Line 20, the word "Conformability" should not be capitalized.

In Column 3, Line 30, the word "Spite" should not be capitalized.

In Column 3, Line 35, the word "Weather" should not be capitalized.

In Column 6, Line 52, the word "Contrary" should not be capitalized.

In Column 14, Lines 36-37, delete the phrase "(characterized in that)".

Signed and Sealed this

Twelfth Day of December, 1995

Bruce Lehman

*Attest:*

BRUCE LEHMAN

*Attesting Officer*

*Commissioner of Patents and Trademarks*